United States Patent [19]

Jarmofsky, deceased et al.

[11] 4,032,215

[45] June 28, 1977

[54] ELECTRICAL CONTACT FOR WIRE AND PIN WITH COMMON STOP

[75] Inventors: Seymour Jarmofsky, deceased, late of Bethel, Conn.; by Doris F. Jarmofsky, legal representative and heir; by Nancy H. Jarmofsky, heir, both of Bethel, Conn.

[73] Assignee: Litton Systems, Inc., Beverly Hills, Calif.

[22] Filed: Mar. 10, 1976

[21] Appl. No.: 665,711

Related U.S. Application Data

[63] Continuation-in-part of Ser. No. 451,738, March 18, 1974, Pat. No. 3,963,302.

[52] U.S. Cl. ..... 339/258 R; 339/276 T

[51] Int. Cl.[2] ..... H01R 13/12

[58] Field of Search ..... 339/256, 258, 275, 276

[56] References Cited

UNITED STATES PATENTS

| | | | |
|---|---|---|---|
| 3,223,962 | 12/1965 | Hammell | 339/256 R |
| 3,363,224 | 1/1968 | Gluntz | 339/276 T |
| 3,711,819 | 1/1973 | Matthews | 339/258 R |

FOREIGN PATENTS OR APPLICATIONS

| | | | |
|---|---|---|---|
| 620,516 | 11/1962 | Belgium | 339/276 T |
| 1,113,856 | 5/1968 | United Kingdom | 339/258 S |

*Primary Examiner*—Joseph H. McGlynn
*Attorney, Agent, or Firm*—M. Michael Carpenter

[57] ABSTRACT

An improved electrical contact is shown, having a box-like section capable of mating with a square post or round pin at one end and an open barrel section for crimping upon an insulated, stripped wire at the other end. The box-like section and open barrel section are joined by a central box section which includes a retention leaf spring and an internal stop for controlling the seating of the contact upon the square post or round pin, for providing a stop for the wire, and for strengthening the box sections as the contact is crimped upon the wire.

6 Claims, 4 Drawing Figures

ELECTRICAL CONTACT FOR WIRE AND PIN WITH COMMON STOP

BACKGROUND OF THE INVENTION

This application is a continuation-in-part of patent application Ser. No. 451,738, March 18, 1974,now U.S. Pat. No. 3,963,302.

The present invention relates to an electrical contact and, more particularly, to a socket contact that may be crimped onto an insulated wire through the use of an open barrel section at one end; while the open barrel section is joined by a central section to a box-like section at the other end which receives a square post or round pin for providing electrical continuity therebetween.

The utilization of an open barrel section to join a contact to an insulated wire by crimping the open upon the wire is known in the prior art. It is also known to provide a socket contact in which the socket is formed by a box-like section having sping tangs for wiping a square post or a round pin received therein. The joining of the known end sections to form a socket contact that may be mounted in an insulated housing is also known.

The present invention discloses an arrangement wherein a socket contact is placed within an insulated housing to form a connector referred to herein as a "back connector " This connector utilizes a relatively idle dimension on square wirewrap posts that extend, for example, from a back panel, a printed circuit board or a mounting frame on a 0.125×0.125inch grid or a 0.100×0.100inch grid. Conductive wires are attached to each post by automatic equipment which wraps each wire about each post to join various posts for completion of a desired electrical circuit. The back panel, printed circuit board or mounting frame forms a plane from which the square posts extend perpendicularly. Each post may be joined to a second post by a wire wrapped about the two posts just above the mounting plane at a level referred to herein as the $z_1$level. Should an electrical circuit be extended beyond the connection of two square posts to a third post with a wire already wrapped thereon, such extension is accomplished by wrapping a wire on the third square post at the next higher level, referred to herein as the $Z_2$ level.

The piggy back connector in which the electrical contact of the present invention is used may utilize the $Z_1$ or $Z_2$ level or a relatively idle dimension on the square posts. The idle dimension is the next highest level above the $Z_2$ level of each post described herein as the $Z_3$ level. The $Z_3$ level is used to provide further circuit configurations, and the piggy back connector is provided to simplify such configurations.

In the piggy vack connector, it is desirable to provide stops which position the piggy back connector at the $Z_1$ ,$Z_2$ or $Z_3$ level. This may be accomplished through the use of an electrical contact having a stop for the square post or round pin. The stop arrangement for each level should also provide a stop for the wire which is to be crimped within the open barrel section of the contact.

SUMMARY OF THE INVENTION

To achieve the features desired, a contact is provided for electrically connecting a wire, crimped to an open barrel section of the contact, to a square post or round pin received by a box-like section at the other end of the contact. The open barrel section and box-like end section are joined by a central box secion which includes a retention leaf spring for retaining the socket contact within its insulated housing. Also formed within the central box section is an internal stop which provides a stop for the square post or round pin and, at the same time, provided a stop for the insulated wire as it is inserted into the open barrel section for crimping. The stop further strengthens the central box section and the box-like end section during the crimping operation.

Accordingly, an object of the present invention is to provide an improved electrical contact which provides electrrical continuity between a square post or round pin and an insulated wire.

Another object of the present invention is to provide a crimp socket contact that removalby mounts within an insulated housing to form a connector which mounts on a square post or round pin and provides an electrical connection between such post or pin and an insulated wire connected to the contact. The contact is provided with an internal stop for aligning the housing in which it mounts on the post or pin and for aligning the insulated wire within the contact before the wire is crimped to the contact.

other objects and afvantages of the present invention will become apparent to those skilled in the art after consideration of this specification in combination with the referenced drawings, wherein:

DESCRIPTION OF THE PREFERRED EMBODIMENT

Figure 1:
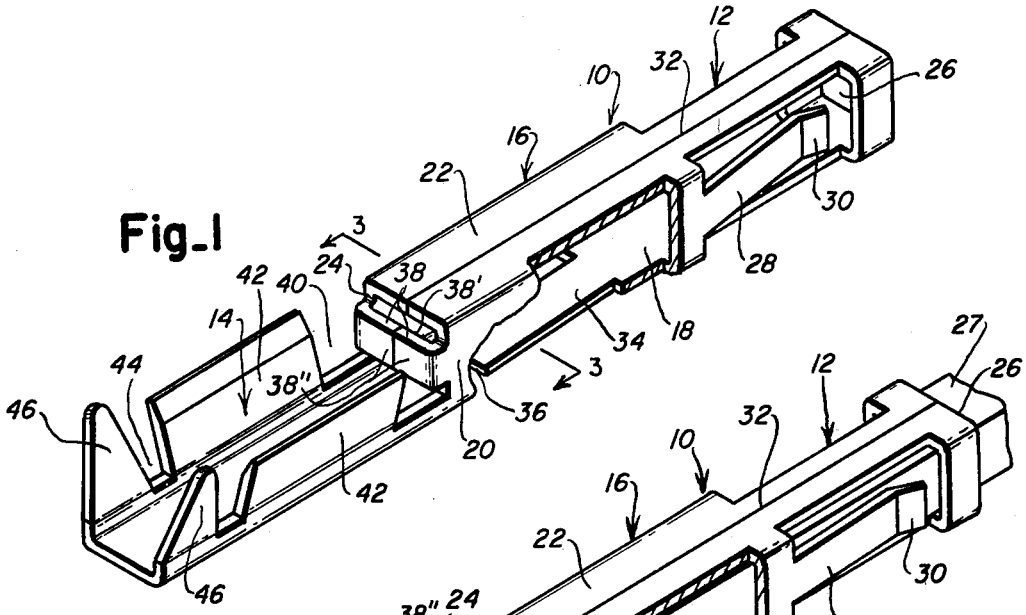
FIG. 1 is a perspective view of an electrical contact of the present invention.

Referring now to FIG. 1 of the drawings, the electrical contact of the present invention is shown generally at 10 having a box-like end section 12 and an open barrel section 14 joined be a central box section 16. The contact may be formed by stamping a thin metal sheet, such as beryllium cooper, into the configuration illustrated. The sections 12 and 14 are formed with a square cross section from four equal side walls, including lower side 18, near side 20, upper side 22 and far side 24. The box-like section 12 is formed with an open end 26 sized to receive either a square post or round pin 27 shown in FIG. 2. Cantilevered spring tangs 28 for wiping the post or pin 27 are formed in near side wall 20 and far side wall 24 with a free end 30 nearest the open end 26 deformed into the box-like section 12 and the other ends of tangs 28 integral with the respective side walls. The upper side wall 22 is symmetrically formed by equally foreshortened portions which abut one another at the center of the side wall 22 to form a longitudinal slot 32 parallel to the longitudinal axis of the contact 10.

Figure 3:
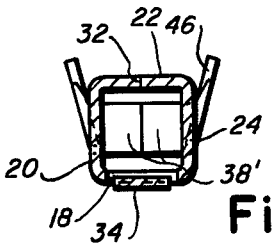
FIG. 3 is a cross-sectional view taken along lines 3—3 of FIG. 1.

Side walls 18, 20, 22 and 24 are extended for forming the central box section 16 of contact 10, as best seen in FIG. 3. in the central box section, lower side 18 is relieved to form a retention leaf spring 34 having its free end 36 extending outwardly from the lower side 18 in a direction away from the open end 26.

The contact shown in FIG. 1 is arranged to provide stops which retain the contact and thus its connector at the $Z_1$ level. A contact which retains its connector at the $Z_2$ and $Z_3$ levels is shown in co-pending U.S. patent application Ser. No. 451,738 , filed march 18, 1974 .

The near and far side walls 20 and 24 of the central box section 16 are each provided with an extending stop tab 38 which is integrally connected to the left-hand edge of each side wall, as viewed in FIG. 1, at the point where these side walls form the bottom of the central box section. Tabs 38 are deformed at right angles to the side walls 20 and 24 for creating inner and outer surfaces. The inner surface 38' of tab 38 provides a stop for post 27 at the bottom of the central section 16 while the outer surfaces 38'' provide a stop at the top of the open barrel section 12 for an insulated wire 39. The stop tabs 38 may be designed to abut each other after deformation or to abut the top and bottom side walls 18 and 22. This will strengthen the end box section 12 and central box section 16 when the open barrel section 14 is crimped upon the insulated wire.

The open barrel section 14 is formed by the extension of the lower side wall 18, near side wall 20 and far side wall 24 of the central box section 16. In the U-shaped open barrel section, near side wall 20 and far side wall 24 are relieved at 40 to form wire crimping beams 42 in each wall. The near and far sides 20 and 24 are again relieved at 44 to form insulation crimping beams 46. The insulation crimping beams 46 and wire crimping beams 42 are shown in their uncrimped configuration prior to being crimped upon the insulated wire 39.

Figure 2:
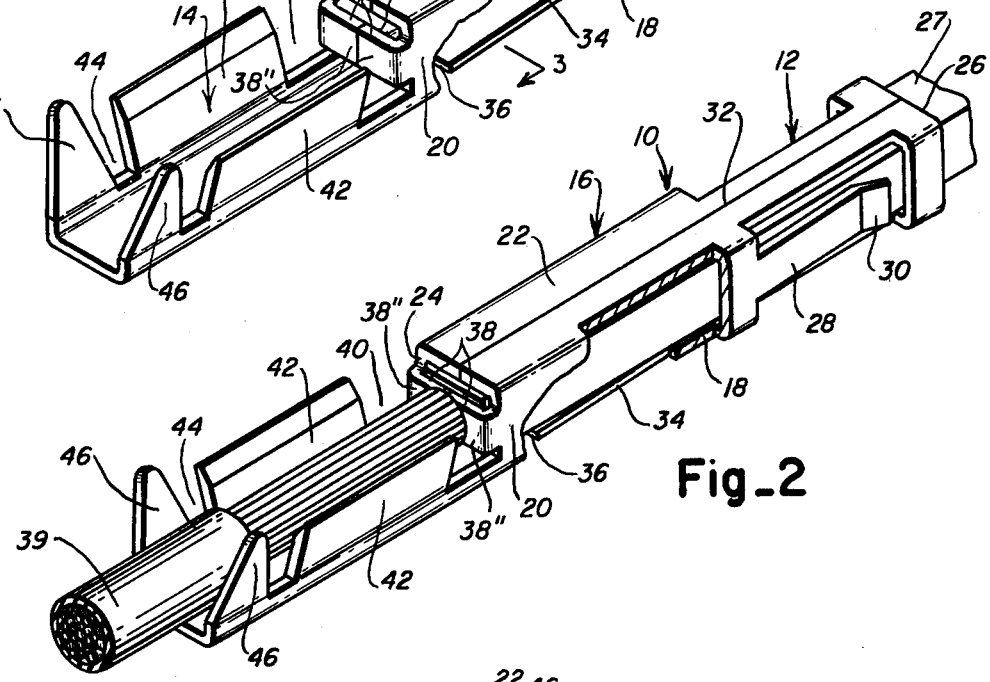
FIG.2 is a perspective view of the electrical contact of th present invention, showing an insulated wire and a pin against a common internal stop.
Figure 4:
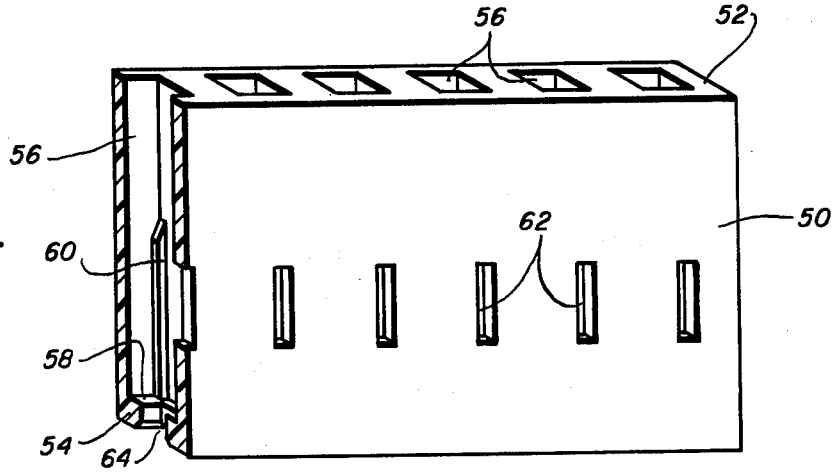
FIG 4. is a perspective view of an insulated housing, shown partially broken away, which removable receives the contact shown in FIGS. 1 and 2.

Referring now to FIG. 4, an insulated housing 50 is shown which is capable of receiving the contact illustrated in FIGS. 1 and 2. The housing 50 has a generally rectangular cross section with upper and lower surfaces 52 and 54, respectively. Extending between the upper and lower surfaces are a plurality of contact receiving chambers 56 also having a generally rectangular configuration when cross sectioned along a plane perpendicular to the upper and lower surfaces 52 and 54. Each chamber 18 has a generally square cross section when viewed from either the upper or lower surface. From the upper surface 52, the chamber 56 extends downwardly to a shoulder 58 located near the lower surface 54. The chamber is also provided with four area reducing members 60 in each corner which engage the contacts 10 as they are inserted into the chamber 56 from the upper surface 52. As each contact 10 is inserted into the chamber 56, the retention leaf spring 34 is deflected inwardly by an inner side of the chamber 56. As the open end 26 of the box-like end section 12 contacts the shoulder 58, the leaf spring 34 is aligned with an opening 62 located within one side wall of the housing 50 between the surfaces 52 and 54. The leaf spring is then urged by its own resiliency into the opening 62 for locking the contact 10 into the housing 50. The housng 50 is further provided with a restricted opening 64 in the lower surface 54 for guiding a square wrap post or round pin 37 into the housing chamber 56 and the contact 10 retained therein.

If desired, the contact 10 and its connected wire 39 may be removed from the housing 50 by the insertion of an appropriate contact removal tool into the opening 62 for deflecting the leaf spring 34 from the opening 62, thus freeing the contact for removal. An example of a suitable contact removal tool is shown in U.S. Letters Pat. No. 3,852,864.

The contacts shown in FIGS. 1 and 2 provide a stop which prevents the housing 50 in which they may be mounted from being inserted onto a series of square posts or round pins more than the distance established by the right-hand surface of the stop walls 38. The stops also provide a stop for the stripped insulated wire 39 which is inserted into the open barrel section 14. When the end of the wire abuts the left-hand surface of the stop walls 38, the wire is stopped and partially retained until an appropriate crimping tool deforms the wire crimping beams 42 and insulation crimping beams 46 about the wire. The deformation of the beams 42 and 46 is prevented from closing the central box section 16 and the box-like end section 12 by the presence of abutting stop walls 38.

It will be understood that the preferred embodiment of the contact shown in the drawings may be modified to provide other variations. For example, one wall or tab may be used in place of two. After consideration of the foregoing specification and referenced drawings, further modifications and variations of the present invention will become apparent to those skilled in the art.

The embodiments in the invention in which an exclusive property or privilege is claimed are defined as follows:

1. An electrical contact for joining electrically conductive elements, comprising:

a first conductive element;

a box-like end section for receiving said first conductive element formed from a metal sheet having four side walls;

a second conductive element;

an open barrel crimp section for receiving said second conductive element;

a central box section formed by the extension of said four walls of said box-like end section;

one of said four walls further extended for joining said central box section and said open barrel crimp section;

support means formed by the further extension of two of said four walls perpendicular to said four walls having contiguous facing surfaces for strengthening said contact; and said support means formed by said two perpendicular walls having inner surfaces abutting said first conductive element and outer surfaces abutting said second conductive element to form a stop for said first and second conductive elements whose contiguous surfaces and abutting contact with said first and second conductive elements further strengthens said contact.

2. An electrical contact as claimed in claim 1 wherein said first conductive element is a square post.

3. An electrical contact as claimed in claim 1 wherein said first conductive element is a round pin.

4. An electrical contact as claimed in claim 1 wherein said second conductive element is an insulated wire.

5. An electrical contact as claimed in claim 1 wherein said four side walls are equal in width and said contact is square.

6. An electrical contact for joining electrically conductive elements, comprising:

a conductive pin;

a box-like end section for receiving said pin formed from four equal side walls;

a conductive wire;

an open barrel crimp section for receiving said wire;

one of said four walls extended from said box-like end section to join said open barrel crimp section thereto;

two more of said four walls extending perpendicularly into said box-like end section at the jointure of said open barrel crimp section having contiguous facing edges to form a contact support for strengthening said contact; and said contact support formed by said two perpendicularly extending walls having inner and outer surfaces, said inner surfaces abutting said pin and said outer surfaces abutting said wire to form a contact stop whose contiguous edges and abutting contact with said pin and wire further strengthen said contact while stopping said pin and wire.

* * * * *